US009678469B2

(12) United States Patent
Shima

(10) Patent No.: US 9,678,469 B2
(45) Date of Patent: Jun. 13, 2017

(54) COLLECTED TONER CONTAINER

(71) Applicant: CANON KABUSHIKI KAISHA, Tokyo (JP)

(72) Inventor: Toshihide Shima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/313,092

(22) Filed: Jun. 24, 2014

(65) Prior Publication Data

US 2015/0003881 A1 Jan. 1, 2015

(30) Foreign Application Priority Data

Jun. 26, 2013 (JP) ..... 2013-133291
Jun. 9, 2014 (JP) ..... 2014-118393

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01)

(58) Field of Classification Search
CPC combination set(s) only.
See application file for complete search history.

(56) References Cited

U.S. PATENT DOCUMENTS

2008/0025763 A1* 1/2008 Suenami ..... 399/256
2014/0334860 A1 11/2014 Shima

FOREIGN PATENT DOCUMENTS

| | | | | |
|---|---|---|---|---|
| JP | H10-260618 A | * | 3/1997 | ..... G03G 21/00 |
| JP | 10-260618 | | 9/1998 | |
| JP | 2000-075747 | | 3/2000 | |
| JP | 2009-271276 | | 11/2009 | |
| JP | 2012-042789 | | 3/2012 | |
| JP | 2012-058583 | | 3/2012 | |
| JP | 2013-044884 | | 4/2013 | |

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A collected toner container includes a container with a collecting port receiving a collected toner on one end in a longitudinal direction and a conveying member convey the toner collected from the collecting port from the one end toward the other end. The conveying member includes a plurality of forward conveyance sections and a plurality of reverse conveyance sections configured to convey the toner in a direction opposite to the forward conveyance section. The reverse conveyance sections are arranged alternately with the forward conveyance sections in an axial direction and a length of a downstreammost reverse conveyance section, in the direction of conveyance of the forward conveyance sections, is formed to be longest among the plurality of reverse conveyance sections.

38 Claims, 12 Drawing Sheets

FIG.2A DRUM CLEANING UNIT
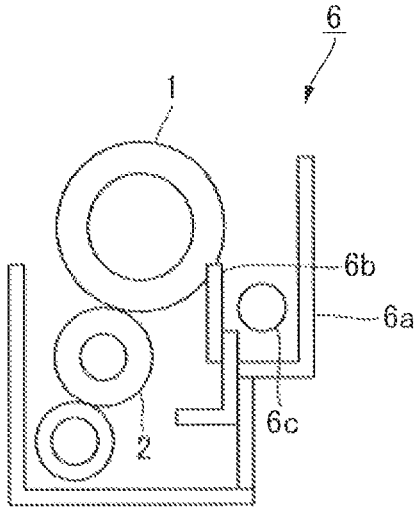
FIG.2B BELT CLEANING UNIT
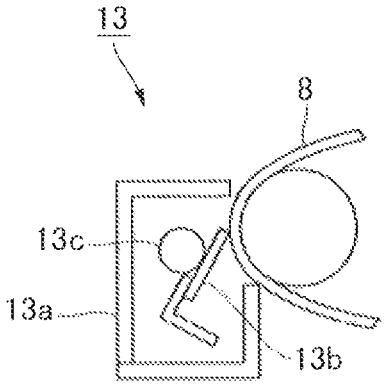

COLLECTED TONER CONTAINER

BACKGROUND OF THE INVENTION

Field of the Invention

This disclosure relates to a collected toner container storing a corrected toner.

Description of the Related Art

An image forming apparatus configured to collect and accumulate a developer, an additive agent, paper powder and the like collected from a developing unit, a belt cleaning unit, photoconductive drums and the like into a collected toner container arranged in a housing of the image forming apparatus is widely used. As a result of an attempt made to store the collected toner container compactly in the housing of the image forming apparatus, there is a case where an appearance configuration of the collected toner container may hinder an effective accumulation of the developer in the collected toner container. For example, in order to accumulate the developer so as to be dispersed over the entire part of the collected toner container having an elongated appearance configuration, the developer supplied to an end of the collected toner container needs to be conveyed to the other end.

In a collected toner container of Japanese Patent Laid-Open No. 2009-271276, a screw conveying member is arranged in an inside space of the elongated collected toner container, and delivers the developer to the entire part of the inside space by conveying the developer from both ends to a center of the inside space in association with a rotation of a screw member.

Japanese Patent Laid-Open No. 2013-44884 discloses a screw member configured to convey waste toner from one end to the other end in the collecting container, including screws configured to convey the toner in directions opposite to each other and being arranged alternately on the same axis in order to improve a storage efficiency of the collecting container. In the configuration disclosed in Japanese Patent Laid-Open No. 2013-44884, a first helical screw portion configured to convey the toner in a forward direction, and a second helical screw portion configured to convey the toner in a reverse direction of the screw member are arranged alternately, and the number of turns of the second helical screw portion is constant.

Therefore, there are the following problems. If the number of turns of the reverse conveyance screw is increased in order to improve filling efficiency, the amount of returned toner at a merge portion between a forward conveyance section and a reverse conveyance section is increased, and hence there is a probability that the toner is clogged and spills out on the upstream side of the collecting container in the direction of conveyance. In contrast, if the number of turns of the reverse conveyance screw is reduced uniformly, the following problem may occur. In other words, an amount of filled toner at the merge portion between the forward conveyance section and the reverse conveyance section is disadvantageously reduced as it goes downstream in the direction of conveyance.

The reason is as follows. According to the review of the inventors, the toner is heaped up at the merge portion between the forward conveyance section and the reverse conveyance section. At the merge section, if toner of a predetermined amount is heaped up high at a merge portion, the toner is conveyed toward a next merge section on the downstream side before the former merge section is completely filled up. While the toner is conveyed to the merge portion on the downstream side, filling at the merge portion on the upstream side is still in progress. Therefore, the filling rate at the merge portion on the upstream side tends to be higher than that at the merge portion on the downstream side. Therefore, there is a probability that the filling rate on the downstream side is lowered if the number of turns of the reverse conveyance screw is constant.

SUMMARY OF THE INVENTION

According to an aspect of the present invention, there is provided a collected toner container which includes a container with a collecting port receiving a collected toner on one end in a longitudinal direction, a conveying member arranged rotatably in the container to convey the toner collected from the collecting port from the one end toward the other end, the conveying member comprising, a plurality of forward conveyance sections configured to convey the toner from the one end to the other end, and a plurality of reverse conveyance sections configured to convey the toner in a direction opposite to the forward conveyance section and arranged alternately with the forward conveyance sections in an axial direction, a length of a downstreammost reverse conveyance section, in the direction of conveyance of the forward conveyance sections, formed to be longest among the plurality of reverse conveyance sections.

Further features of the present invention will become apparent from the following description of exemplary embodiments with reference to the attached drawings.

BRIEF DESCRIPTION OF THE DRAWINGS

FIGS. 2A and 2B are explanatory drawings illustrating configurations of cleaning unit.

DESCRIPTION OF THE EMBODIMENTS

Figure 1:
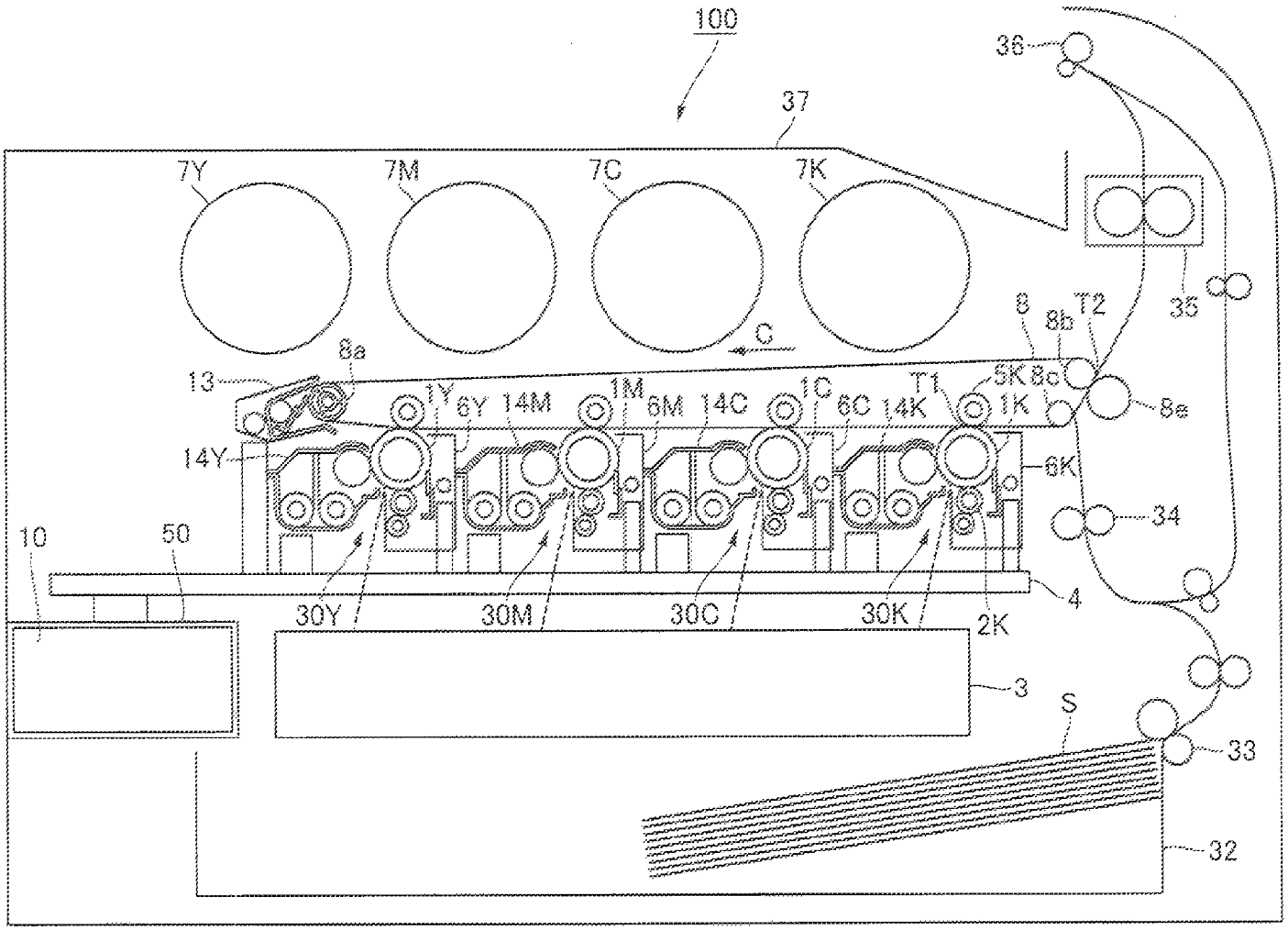
FIG. 1 is an explanatory drawing illustrating a configuration of an image forming apparatus.

Referring now to the drawings, embodiments of this disclosure will be described in detail.

First Embodiment

As illustrated in FIG. 1, a drum cleaning unit 6 and a belt cleaning unit 13, which are examples of the cleaning unit, are configured to collect toner adhered to an image carrier. A toner conveyance pipe 4, which is an example of a conveyance path, guides the toner collected by the cleaning unit to an opening of a collected toner container 10, and supplies the same to the inside space thereof. The collected toner container 10, which is an example of the container, is arranged so as to be capable of taking out from a housing of an image forming apparatus.

Figure 3:
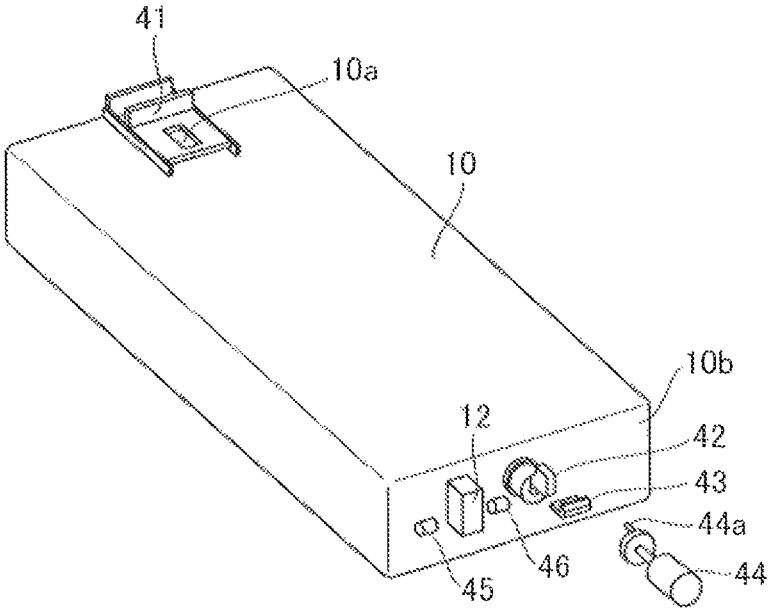
FIG. 3 is a perspective view of a collected toner container.

As illustrated in FIG. 3, the collected toner container 10 has a length in a first direction extending from one end to the other end longer than a second direction at a right angle with respect to the first direction, and includes an opening 10*a*, which is an example of an inlet port for the collected developer, arranged at one end thereof. The collected toner container 10 is a substantially rectangular parallelepiped having long sides in the first direction, short sides in the second direction, and a height in a direction at a right angle with respect to the first direction and the second direction.

Figure 4:
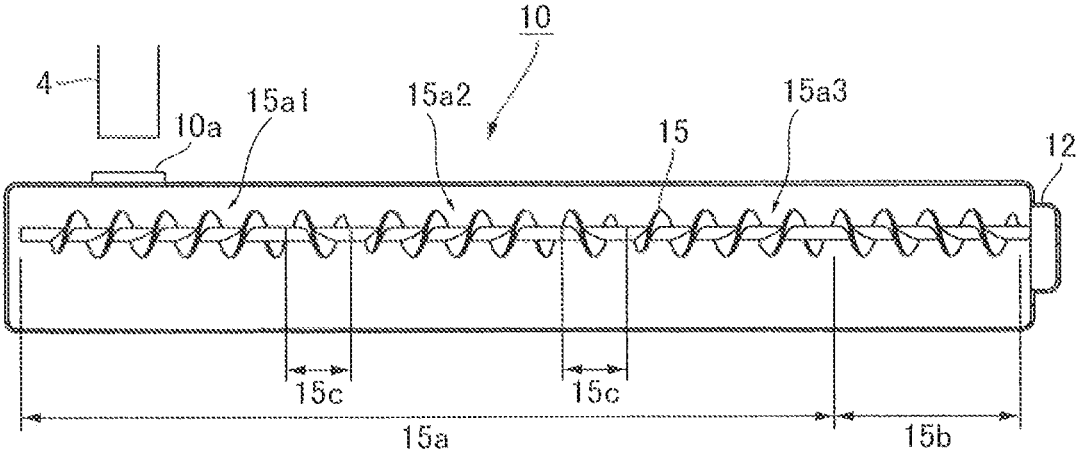
FIG. 4 is a cross-sectional view taken along a screw of the collected toner container.

As illustrated in FIG. 4, a screw 15, which is an example of a conveying member, is arranged in the inside space of the collected toner container 10 along the first direction. As illustrated in FIG. 3, a drive connecting portion 42, which is an example of a drive force transmitting portion, receives a drive force from a drive source arranged in the housing of the image forming apparatus on the screw 15. The drive connecting portion 42 releases a transmission of the drive force on an action of taking out the collected toner container 10 from the housing of the image forming apparatus.

As illustrated in FIG. 4, a forward feeding area 15*a*, which is an example of forward conveyance sections (forward feeding portions), exhibits a conveyance performance in the first direction in association with the rotation. The forward feeding area 15*a* includes a screw blade that exhibits the conveyance performance in the first direction in association with the rotation. A reverse feeding area 15*c*, which is an example of an intermediate portion, is arranged between the forward conveyance sections, and does not exhibit the conveyance performance in the first direction in association with the rotation. Although there are provided two areas 15*c* in First embodiment, only one of those may be described for the sake of convenience of description. The reverse feeding areas 15*c* each include a screw blade that exhibits a conveyance performance in a direction opposite to the first direction in association with the rotation.

A reverse feeding area 15*b*, which is an example of an end reverse feeding portion, is provided on the other end of the screw 15 and exhibits a conveyance performance in a direction opposite to the first direction in association with the rotation. The reverse feeding areas 15*c* are provided in the forward feeding area 15*a* between the reverse feeding area 15*b* of the screw 15 and the opening 10*a*.

As illustrated in FIGS. 5A to 5G, the length of the reverse feeding area 15*c* is a length which can feed the developer to the forward feeding area 15*a* on the downstream side of the reverse feeding area 15*c* while bypassing the reverse feeding area 15*c* by using a conveyance performance of the forward feeding area 15*a* on the upstream side of the reverse feeding area 15*c*. According to an experiment, when pitches of the screw blade of the forward feeding area 15*a* and the reverse feeding area 15*c* are the same, a suitable length of the reverse feeding area 15*c* is not longer than three pitches of the screw blade.

Image Forming Apparatus

FIG. 1 is an explanatory drawing illustrating a configuration of an image forming apparatus. As illustrated in FIG. 1, an image forming apparatus 100 is a tandem-type intermediate transfer system full-color printer in which image forming portions 30Y, 30M, 30C, and 30K are arranged along a surface of an intermediate transfer belt 8 facing downward.

In the image forming portion 30Y, a yellow toner image is formed on a photoconductive drum 1Y and is transferred to the intermediate transfer belt 8. In the image forming portion 30M, a magenta toner image is formed on a photoconductive drum 1M and is transferred to the intermediate transfer belt 8. In the image forming portions 30C and 30K, a cyan toner image and a black toner image are formed respectively on photoconductive drums 1C and 1K and are transferred to the intermediate transfer belt 8.

A four-color toner image transferred to the intermediate transfer belt 8 is conveyed to a secondary transfer portion T2, and is secondarily transferred to a recording medium S. Separation rollers 33 separate the recording medium S drawn out from a recording medium cassette 32 into pieces and feed the same to registration rollers 34. The registration rollers 34 feed the recording medium S to the secondary transfer portion T2 so as to be timed with the toner image on the intermediate transfer belt 8. The recording medium S to which the four-color toner image is secondarily transferred is subject to a heat pressure by a fixing unit 35, and a toner image is fixed to a front surface thereof.

Image Forming Portion

The image forming portions 30Y, 30M, 30C, and 30K have substantially the same configuration except that colors of toners used in developing units 14Y, 14M, 14C, and 14K are different, and are yellow, magenta, cyan, and black. In the following description, the image forming portion 30K will be described, and overlapped description of the image forming portion 30Y, 30M, 30C will be omitted.

The image forming portion 30K includes a charge unit 2K, an exposure unit 3, a developing unit 14K, a transfer roller 5K, and a drum cleaning unit 6K so as to surround the photoconductive drum 1K. The photoconductive drum 1K includes a photoconductive layer formed on an outer peripheral surface of an aluminum cylinder, and rotates at a predetermined process speed.

The charge unit 2K charges the photoconductive drum 1K at a uniform negative potential. The exposure unit 3 scans the photoconductive drum 1K with a laser beam which is a scanning line image signal subjected to ON-OFF modulation with a rotating mirror, thereby writing an electrostatic image on the photoconductive drum 1K. The developing unit 14K transfers the toner to the photoconductive drum 1K and develops the electrostatic image into a toner image. New toner of an amount corresponding to the amount of toner consumed by the developing unit 14K due to the image formation is supplied from a toner cartridge 7K to the developing unit 14K.

The transfer roller 5K presses the intermediate transfer belt 8 and forms a transfer portion between the photoconductive drum 1K and the intermediate transfer belt 8. A DC voltage having a positive polarity is applied to the transfer roller 5, whereby the toner image having a negative polarity and being born by the photoconductive drum 1K is transferred to the intermediate transfer belt 8. The intermediate transfer belt 8 is extended around a tension roller 8*a*, a drive roller 8*b* which also serves as a secondary transfer opposed roller, and an extension roller 8*c*, and is supported thereby, and is driven by the drive roller 8*b* and rotates in a direction indicated by an arrow C. A secondary transfer roller 8*e* forms a secondary transfer portion T2 by abutting against the intermediate transfer belt 8 supported by the drive roller 8*b* from an inner side surface thereof. A DC voltage having a positive polarity is applied to the secondary transfer roller 8*e*, so that the toner image on the intermediate transfer belt 8 is transferred to the recording medium S.

Drum Cleaning Unit

FIGS. 2A and 2B are explanatory drawings illustrating configurations of a cleaning unit. FIG. 2A illustrates a drum cleaning unit, and FIG. 2B illustrates a belt cleaning unit.

As illustrated in FIG. 2A, a drum cleaning unit 6 causes a cleaning blade 6*b* to slide along the photoconductive drum 1 and collects residual toner failed to be transferred and adhered to the photoconductive drum 1. In this example, the drum cleaning unit 6 employs a rubber-blade system. However, the system of the drum cleaning unit 6 is not limited thereto.

The drum cleaning unit 6 includes the cleaning blade 6*b* and a toner conveyance screw 6*c* provided in the interior of a cleaning container 6*a* along a longitudinal direction of the cleaning container. The cleaning blade 6*b* is a elastic blade formed of urethane rubber, and brings an edge at a distal end thereof into abutment with the peripheral surface of the rotating photoconductive drum 1 in a counter direction.

The cleaning blade 6*b* slides along the peripheral surface of the rotating photoconductive drum 1, and scrapes off the toner failed to be transferred and adhered to the peripheral surface of the photoconductive drum 1 into the cleaning container 6*a*. The toner conveyance screw 6*c* rotates and conveys the scraped toner in the cleaning container 6*a* from a far side to a near side in the longitudinal direction. The toner conveyed to the near side is fed to a common toner conveyance pipe 4 through a discharge port provided in the near side of the cleaning container 6*a*.

Belt Cleaning Unit

As illustrated in FIG. 2B, a belt cleaning unit 13 causes a cleaning blade 13*b* to slide along the intermediate transfer belt 8 to collect toner failed to be transferred from the surface of the intermediate transfer belt 8. In this example, the belt cleaning unit 13 employs a rubber-blade system. However, the system of the belt cleaning unit 13 is not limited thereto.

The belt cleaning unit 13 includes the cleaning blade 13*b* and a toner conveyance screw 13*c* provided in the interior of a cleaning container 13*a* along a longitudinal direction of the cleaning container. The cleaning blade 13*b* is a elastic blade formed of urethane rubber, and brings an edge at a distal end thereof into abutment with the peripheral surface of the rotating intermediate transfer belt 8 in a counter direction.

The cleaning blade 13*b* slides along the peripheral surface of the rotating intermediate transfer belt 8, and scrapes off the toner failed to be transferred and adhered to the peripheral surface of the intermediate transfer belt 8 into the cleaning container 13*a*. The toner conveyance screw 13*c* rotates and conveys the scraped toner in the cleaning container 13*a* from a far side to a near side in the longitudinal direction. The toner conveyed to the near side is fed to the common toner conveyance pipe 4 for conveying collected toner through a discharge port provided in the near side of the cleaning container 13*a*.

Conveyance Path

As illustrated in FIG. 1, a conveyance screw, which is not illustrated, configured to convey collected toner from the right to the left in the drawing in association with the rotation is provided in the toner conveyance pipe 4. A container storage portion 50 is provided in the housing of the image forming apparatus 100 under the toner conveyance pipe 4. The collected toner discharged from the drum cleaning units 6Y, 6M, 6C, 6K is merged with the collected toner discharged from the belt cleaning unit 13 in the toner conveyance pipe 4. The merged collected toner is conveyed in the toner conveyance pipe 4 toward the collected toner container 10 and is supplied into the collected toner container 10.

Collected Toner Container Storage Portion

As illustrated in FIG. 1, a container storage portion 50 holds a collected toner container 10 so as to be insertable/removable in the direction perpendicular the paper surface. The collected toner container 10 is demountably mounted in the container storage portion 50. When the amount of collected toner reaches a predetermined amount, the collected toner container 10 is drawn out from the container storage portion 50 and is replaced with a new empty collected toner container 10.

Collected Toner Container

FIG. 3 is a perspective view of the collected toner container 10. FIG. 4 is a cross-sectional view taken along a screw of the collected toner container 10. As illustrated in FIG. 3, the collected toner container 10 is a sealed container having an appearance of a substantially rectangular parallelepiped formed of soft plastic by air-blow molding. The collected toner container 10 has a length of 480 mm, a width of 200 mm, and a height of 100 mm.

The collected toner container 10 has an opening 10*a* on an upper surface on one end. The opening 10*a* is provided with a shutter 41 configured to be opened and closed in conjunction with mounting and demounting of the collected toner container 10 with respect to the image forming apparatus. The collected toner container 10 includes a projecting shape portion 12 on a side surface wall portion 10*b* on the other end.

The projecting shape portion 12 is a transparent projection used for detecting toner powder surface in the collected toner container 10. The projecting shape portion blocks a detecting optical path formed between a light-emitting portion 45 and a light receiving portion 46 arranged in the image forming apparatus. In a state in which no toner exists in the projecting shape portion 12, light from the light-emitting portion 45 enters the light receiving portion 46, so that it is determined that the collected toner may further be accumulated. When the projecting shape portion 12 is filled with toner, light from the light-emitting portion 45 does not enter the light receiving portion 46, so that it is determined that the amount of collected toner in the collected toner container 10 reaches a predetermined amount. That is, the projecting shape portion 12 composes a storage portion configured to store the toner and indicates a full condition of the container 10D by storing the toner by a predetermined amount therein. Then the light-emitting portion 45 and the light receiving portion 46 detect whether the toner is stored in the projecting shape portion 12 by the predetermined amount or not and the image forming apparatus prompts replacement of the collected toner container 10 via a display on an operating panel when the light-emitting portion 45 and the light receiving portion 46 detect the state of the projecting shape portion 12 indicating the full condition of the container 10D.

If toner dropped from the opening 10*a* rises into air and adhered to an inner wall surface of the projecting shape portion 12, light from the light-emitting portion 45 is blocked, so that the state of toner accumulation in the collected toner container 10 may be determined erroneously. Therefore, the opening 10*a* and the projecting shape portion 12 are arranged apart from each other in the longitudinal direction.

As illustrated in FIG. 4, a screw 15 including a plurality of forward conveyance sections 15*a*1 through 15*a*3 and configured to be capable of conveying the toner from one end to the other end of the collected toner container 10 is arranged in an upper portion of the inside space of the collected toner container 10. The screw 15 is rotatably held by bearings provided on one end and the other end of the collected toner container 10. The screw 15 is formed of plastic. A blade shape of the area 15*a* of the screw 15 configured to convey the toner to the downstream side has an outer diameter of ϕ20 mm, an inner diameter of ϕ8 mm, and a pitch of 20 mm.

As illustrated in FIG. 3, a shaft end of the screw 15 at the other end projects outward from the collected toner container 10, and the drive connecting portion 42 is fixed to the projected shaft end. A drive motor 44 provided with a pin 44*a* is arranged on the image forming apparatus side. The pin 44*a* engages with and rotates the drive connecting portion 42, so that the screw 15 is rotated correspondingly.

Screw

As illustrated in FIG. 4, an area 15*a* of the screw (screw member) 15 is formed to have a blade shape which can feed the toner from the opening 10*a* toward the projecting shape portion 12 in association with the rotation.

The screw 15 has an outer diameter of 20 mm. An area 15*b* of the screw 15 is formed to have a blade shape which can feed the toner from the projecting shape portion 12 toward the opening 10*a* in association with the rotation. The screw shape in the area 15*b* has the same outer diameter, inner diameter and screw pitch as the screw shape in the area 15*a*, but has an opposite direction of helical winding of the screw. The area 15*b* has a length corresponding to four pitches of the screw.

Areas 15*c* of the screw 15 are arranged within a segment having a blade shape configured to feed the collected toner from the opening 10*a* of the area 15*a* to the projecting shape portion 12. The areas 15*c* are each formed to have a blade shape which can feed the toner from the projecting shape portion 12 toward the opening 10*a* in association with the rotation. The screw shape in the areas 15*c* have the same outer diameter, the inner diameter and the screw pitch as the screw shape in the area 15*a*, but has a helical winding of the screw in the opposite direction. The areas 15*c* each have a length corresponding to one pitch of the screw. The areas 15*b* and 15*c* of the screw 15 compose a plurality of reverse conveyance sections configured to convey the toner in a direction opposite to the forward conveyance sections. The reverse conveyance sections 15*b* and 15*c* and the forward conveyance sections 15*a*1 through 15*a*3 are arranged alternately in an axial direction of the screw 15. A length of a downstreammost reverse conveyance section 15*b* in the direction of conveyance of the forward conveyance sections 15*a*1 through 15*a*3 are formed to be longest among the plurality of reverse conveyance sections 15*b* and 15*c*. Also, a length of each of reverse conveyance sections 15*c* located upstream the downstreammost reverse conveyance section 15*b* is less than three pitches.

Collected Toner Accumulation Process

FIGS. 5A to 5G are explanatory drawings illustrating the toner accumulating process in the collected toner container. As illustrated in FIG. 4, the toner collected in the image forming apparatus is merged in the toner conveyance pipe 4, falls freely from a terminal end of the toner conveyance pipe 4 through the opening 10*a* into the collected toner container 10, and accumulates therein. The toner is not conveyed even though the screw 15 is rotated until the toner accumulation level reaches the screw 15 and is heaped up on right below the opening 10*a*. The toner in the collected toner container 10 is built up to a full state through the process illustrated in FIG. 5A to 5G.

Figure 5A:
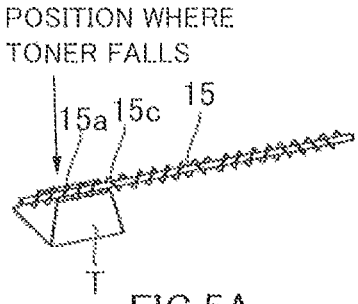
FIGS. 5A to 5G are explanatory drawings illustrating a toner accumulating process in the collected toner container.

As illustrated in FIG. 5A, when the accumulation level of the toner reaches the screw 15, conveyance by the screw 15 starts. The screw 15 rotates so as to convey the toner from one end to the other end in the collected toner container 10, and the collected toner accumulated by free fall is conveyed from one end to the other end along the longitudinal direction. A top portion of the heaped up toner is cut down by the screw 15, and a toner ridge grows from one end toward the other end.

Figure 5B:
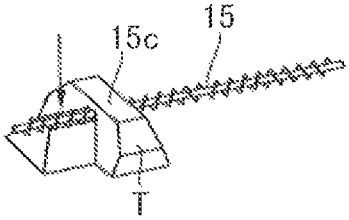

As illustrated in FIG. 5B, the toner ridge conveyed by the area 15*a* of the screw 15 reaches the area 15*c* having an opposite direction of conveyance. In the area 15*c*, the toner piles up because the direction of conveyance of the toner is inverted, and hinders conveyance of the following toner conveyed by the area 15*a*. The toner is not conveyed in the area 15*c* and is heaped up. The toner conveyed from the upstream side collides with the heaped up toner, is pushed outward of the screw 15 in the diameter direction, spreads out over the entire cross section of the collected toner container 10 and is accumulated thereon. The following toner hindered from being conveyed by the piled up toner reaches the side surface and the upper surface in the collected toner container 10. However, in the area 15*c*, filling of the toner is not completely terminated and, from then onward, filling of the toner creeps in the remaining space.

Figure 5C:
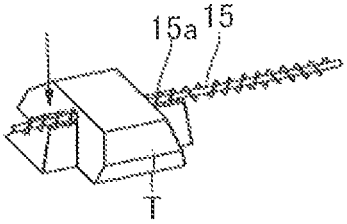

As illustrated in FIG. 5C, accumulation of the toner formed into a heaped shape at the inlet port of the area 15*c* is expanded also toward the downstream side by a conveyance force of the area 15*a* of the screw 15. Also during the conveyance of the toner toward the downstream side of the area 15*c*, the toner is gradually filled into the first area 15*c* although in a slow pace. Accumulation of the toner reaches the area 15*a* on the downstream side beyond the area 15*c*, and is conveyed also to the downstream side. The toner which has entered the area 15*a* of the screw 15 is conveyed in the direction toward the opening 10*a* and in the direction toward the other end in association with the rotation of the screw 15. Accumulation of the toner grows to be pushed out also to the downstream side by a pressure of the toner conveyed and accumulated from the upstream side. The accumulation of the toner pushed out toward the downstream side reaches the area 15*a* on the downstream side, and is conveyed to the downstream side by being pushed by the blade shape of the area 15*a*.

Figure 5D:
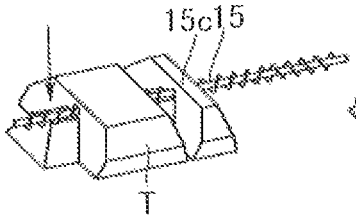

As illustrated in FIG. 5D, when the toner conveyed toward the other end reaches the second area 15*c* having the opposite direction of conveyance again, the toner piles up here again, and the following toner collides with the piled up toner, so that the piled up toner is spread outward in the direction of diameter of the screw 15.

Figure 5E:
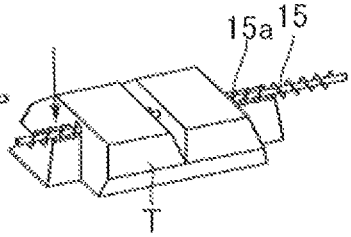

As illustrated in FIG. 5E, when the heaped up toner formed in the area 15*c* grows to the upstream side and the downstream side by a predetermined amount, toner to be conveyed to the area 15*a* located on further downstream side appears as described above. Toner to be conveyed to the other end appears according to the amount of toner to be flowed in from the opening 10*a*. At this time, in the second area 15*a*, the toner is conveyed to the area 15*a* on the further downstream side in the state in which the filling (grow) of toner is not completed. In the same manner as the first area 15*c*, the toner is gradually filled into the second area 15*c* also during the conveyance of the toner toward the downstream side although in a slow pace.

Figure 5F:
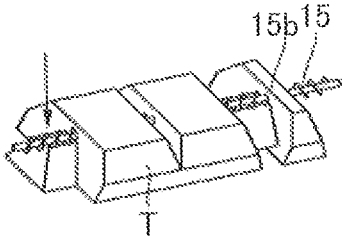

As illustrated in FIG. 5F, the toner conveyed toward the other end piles up when reaching the area 15*b*. In association with piling up, the following toner is pushed outward in the direction of diameter of the screw 15, diffused in the cross section of the collected toner container 10, and is accumulated on the upstream side. Simultaneously, the accumulation of the toner grows also to the downstream side by a conveyance pressure of the area 15*a* of the screw 15.

Figure 5G:
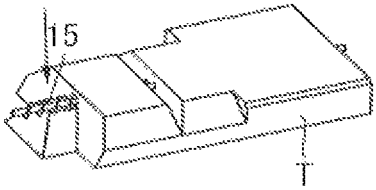

As illustrated in FIG. 5G, if the heaped up toner grows to the downstream side against a conveyance force of the area 15*b* and reaches a side wall on the other end, the projecting shape portion 12 is filled with the toner, so that it is determined that the collected toner container 10 is full. Since the distance of conveyance of the area 15*b* is longer than that of the area 15*c*, the toner is always conveyed to and accumulated on the merge portion with respect to the area 15*a*, so that the toner can be continuously pushed outward in the direction of diameter of the screw 15. Consequently, the toner can further be built up mainly at the merge portion between the screw area 15*a* and the area 15*b*.

If the toner is continuously conveyed to the downstream side by further rotating the screw 15 in a state in which the toner reaches the side wall on the other end and has no way out, a pressure exerted on the toner in the periphery of the screw 15 is increased, and hence a rotation torque of the screw 15 rises. If the rotation torque rises continuously, the screw 15 is finally stopped. Therefore, detecting of the toner powder surface is performed by using the projecting shape portion 12, and replacement of the collected toner container 10 is prompted before the toner pressure is increased and hence the screw 15 is stopped. Since the amount of returning screw in the area 15*b* is longer than the area 15*c*, the pressure of toner may be enhanced when the area 15*b* is filled with the toner. Therefore, an effect of filling the toner into an unfilled area on the upstream side of the area 15*b* at an accelerated rate is achieved, so that filling efficiency may further be enhanced. In this embodiment, although a configuration in which the numbers of turns in the areas 15*c* are the same has been described as an example, this disclosure is not limited thereto. For example, the number of turns may be increased as it goes downstream (as it goes away from the opening 10*a*). In this configuration, in comparison with the case where the number of turns of the areas 15*c* are constant, lowering of the filling rate of the area 15*c* on the downstream side may be compensated, whereby further improvement of the filling rate is achieved.

Advantageous Effects of First Embodiment

The collected toner container 10 of First embodiment allows a large amount of toner to be accumulated therein, and hence reduction of a running cost is achieved by reducing the number of times of replacement.

Since the collected toner container 10 of First embodiment has an appearance of a substantially rectangular parallelepiped, a large amount of collected toner maybe collected in the collected toner container within a limited space in association with downsizing of the image forming apparatus 100.

In the collected toner container 10 of First embodiment, if a powder medium such as toner is accumulated, such a powder medium is heaped up. Therefore, a built-up efficiency is improved by shifting the position to be heaped up. However, since the collected toner is heaped up, the toner in an upper portion in the height direction tends to become a sparse state, and if the capacity of the screw 15 is increased in the radial direction, the sparse portion becomes more outstanding.

The collected toner container 10 of First embodiment does not require to vibrate the container, and is consistent with a product function which requires quietness.

The collected toner container 10 of First embodiment is capable of collecting a large amount of the collected toner efficiently by accumulating the collected toner uniformly in the container with a simple configuration.

The collected toner container 10 of First embodiment switches the direction of conveyance in mid-course by the conveying member. By switching the direction of conveyance in mid-course, a portion where the collected toner is piled up is positively created, so that the collected toner may be built up uniformly in the container. By increasing the built-up efficiency in the collected toner container, the number of times of replacement may be reduced, so that a reduction of a running cost may result. In addition, with an employment of a container configured to accumulate the collected toner in the lateral direction rather than in a heaped manner so as to achieve a container having less height, flexibility of arrangement in an apparatus body is increased, and contribution to the downsizing of the apparatus is resulted.

First Comparative Example

Figure 6:
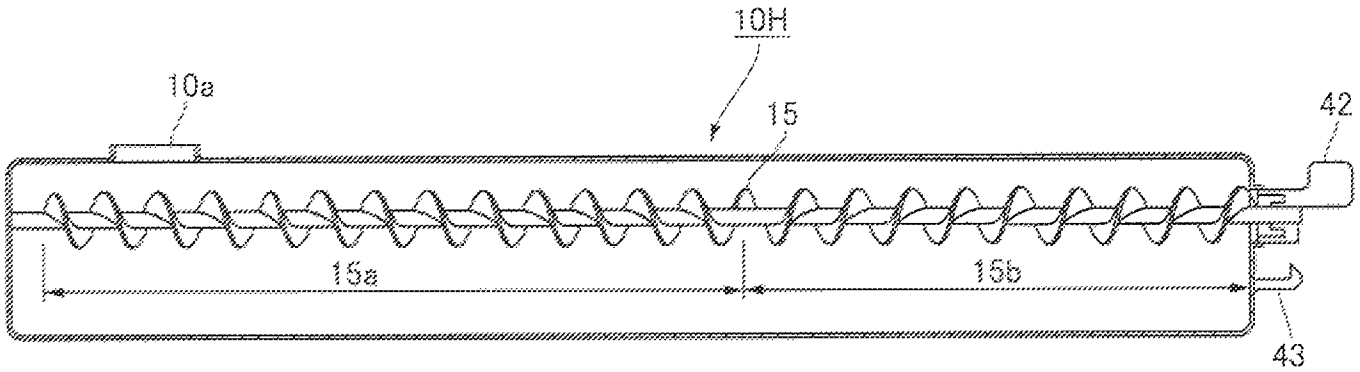
FIG. 6 is an explanatory drawing illustrating a collected toner container of first comparative example.

FIG. 6 is an explanatory drawing illustrating a collected toner container of first comparative example. As illustrated in FIG. 6, a collected toner container 10H of first comparative example is not provided with the areas 15*c* illustrated in FIG. 4, and is provided with the area 15*b* longer than that of the collected toner container 10 of the First embodiment. The screw area 15*a* and the screw area 15*b* are divided at an intermediate position in the longitudinal direction between the opening 10*a* and the projecting shape portion 12.

In this case, the toner accumulated at a boundary position between the area 15*a* and the area 15*b* is dispersed outward in the direction of diameter of the screw 15 and is heaped up, and the heaped up toner grows toward the upstream side and the downstream side in association with the accumulation of the toner in the collected toner container 10. When the toner is built up gradually at a boundary position between the area 15*a* and the area 15*b*, the rotation torque of the screw 15 is increased.

Here, if the length of the collected toner container 10 in the longitudinal direction is short, the toner enters the projecting shape portion 12 before stopping the screw 15, so that it is determined that the collected toner container 10 is full, and driving of the screw 15 is stopped. However, if the length of the collected toner container 10 in the longitudinal direction is increased in order to have a larger capacity of the collected toner container 10, the screw 15 may become overload and stop before the toner enters the projecting shape portion 12.

Therefore, when the length of the collected toner container 10 in the longitudinal direction is increased, such an increase is achieved only by depending specifically on an increase in length of the area 15*b*, so that it is difficult to prevent the screw 15 from being stopped by the over load with the increased length of the area 15*b*. In order to prevent the screw 15 from being stopped by the over load, the length of the area 15*b* is limited.

Therefore, if the length of the collected toner container 10 in the longitudinal direction is increased, the length of the area 15*a* is also increased. Since the toner cannot be delivered to the four corners of the cross section of the area 15*a* only by increasing the length of the area 15*a*, improvement of the amount of toner to be accumulated only on the basis of the increase in capacity of the container in the longitudinal direction cannot be expected. Therefore, provision of the area 15*c* having an opposite direction of conveyance in the area 15*a* as in First embodiment is preferable.

Second Comparative Example

Figure 7:
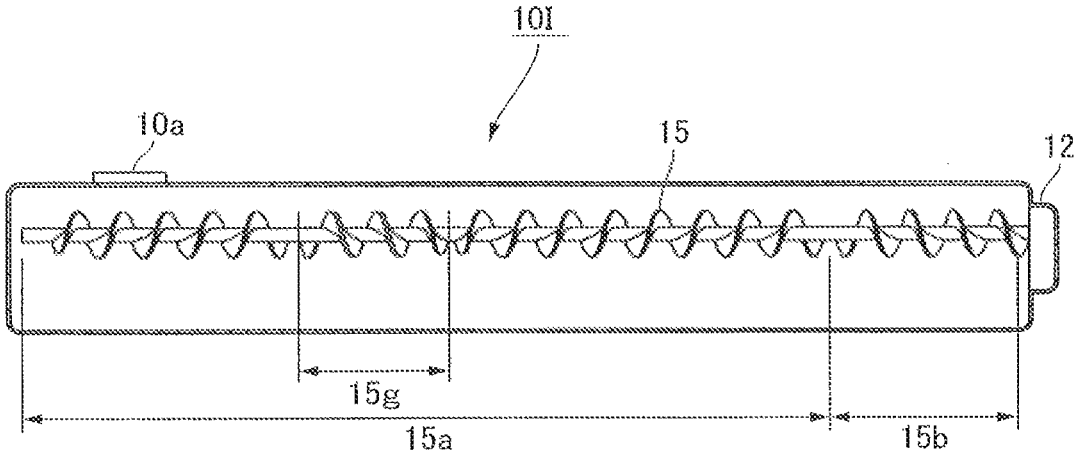
FIG. 7 is a cross-sectional view taken along a screw of a collected toner container of second comparative example.
Figure 8A:
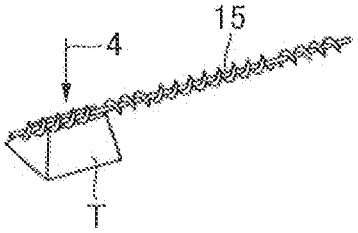
FIGS. 8A to 8C are explanatory drawings illustrating the toner accumulating process in the collected toner container.
Figure 8B:
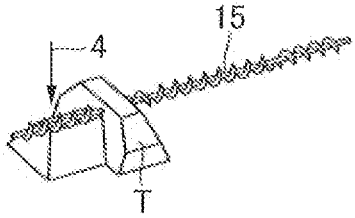
Figure 8C:
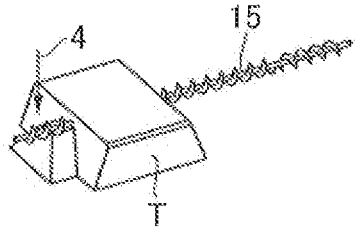
Figure 9:
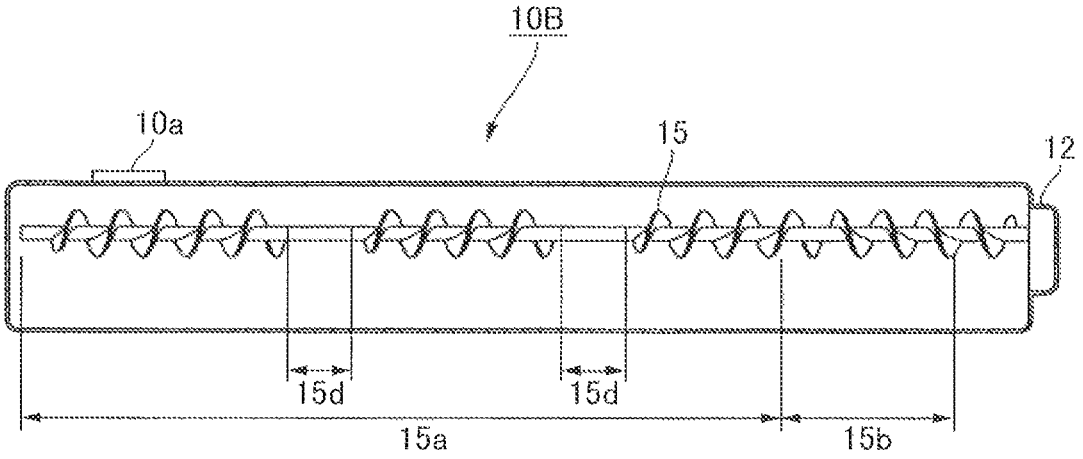
FIG. 9 is a cross-sectional view taken along a screw of a collected toner container of Second embodiment.
Figure 10:
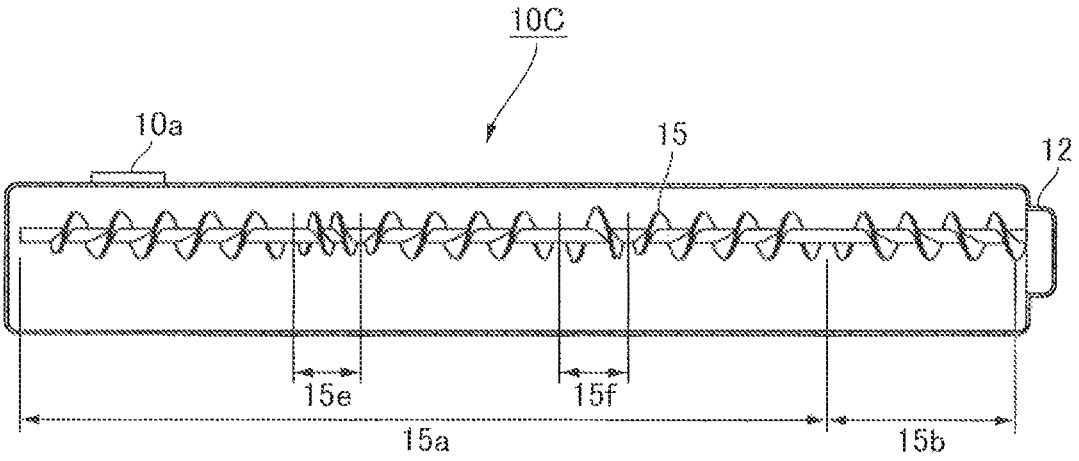
FIG. 10 is a cross-sectional view taken along a screw of a collected toner container of Third embodiment.

FIG. 7 is a cross-sectional view taken along a screw of a collected toner container of second comparative example. FIGS. 8A to 8C are explanatory drawings illustrating a toner accumulating process in the collected toner container. The collected toner container of second comparative example has the same configuration as First embodiment other than that there is only one reverse feeding area 15*g* provided on the screw 15 and is controlled in the same manner. Therefore, members common to First embodiment in FIG. 9 and FIG. 10 are denoted by reference numerals common to those in FIG. 4 and FIG. 5A to 5G, and overlapped description will be omitted.

As illustrated in FIG. 7, the feeding amount per turn of the forward feeding area 15*a* of the screw 15 depends on the pitches of the screw shape, and is 20 mm. The reverse feeding area 15*g* of the screw 15 has a pitch of 20 mm, a number of turns of 3, and a length of 60 mm, so that the feeding amount per turn of the area 15*g* is three times that of the area 15*a*. The toner in the collected toner container 10 is built up through the process illustrated in FIG. 8A to 8C.

As illustrated in FIG. 8A, the toner collected in the image forming apparatus falls freely from a terminal end of the toner conveyance pipe 4 through the opening 10*a* into the collected toner container 10I, and accumulates therein. When the level of the accumulated toner reaches the screw 15, the toner is conveyed to the downstream side in association with the rotation of the screw 15.

As illustrated in FIG. 8B, the collected toner conveyed to the downstream side by the screw 15 reaches the area 15*g* having an opposite direction of conveyance. In the area 15*g*, the toner is piled up and heaped up, then toner conveyed from the upstream side collides with the heaped up toner, is pushed outward of the screw 15 in the diameter direction, spreads out over the width direction of the collected toner container 10I and is accumulated thereon. The following toner reaches the side surface and the upper surface in the collected toner container 10I.

As illustrated in FIG. 8C, the toner heaped up from the boundary between the area 15*a* on the upstream side and the area 15*g* grows toward the upstream side and the downstream side, and enters also the reverse feeding area 15*g*. However, in second comparative example, since the reverse feeding area 15*g* is longer than that of the First embodiment, the collected toner entering the area 15*g* can hardly reach the forward feeding area 15*a* on the downstream side. In the meantime, the collected toner entering the area 15*g* is biased toward the upstream side and pushed toward a side surface, so that the entire cross section of the collected toner container 10I is filled with the toner. In this state, the load of the screw 15 is increased, the motor may be stopped and may not rotate due to the over load.

Therefore, the length of the forward feeding area 15*g* of the screw 15 is preferably not longer than substantially twice the feeding length per turn of the forward feeding area 15*a*.

Second Embodiment

FIG. 9 is a cross-sectional view taken along a screw of a collected toner container of Second embodiment. A collected toner container 10I of Second embodiment has the same configuration as First embodiment other than that the areas 15*d* of the screw do not have a blade shape and is controlled in the same manner. Therefore, members common to First embodiment in FIG. 9 are denoted by reference numerals common to those in FIG. 4, and overlapped description will be omitted. Although there are provided two areas 15*d* in First embodiment, only one of those may be described for the sake of convenience of description.

As illustrated in FIG. 9, a collected toner container 10B of Second embodiment does not have a blade shape in the area 15*d* of the screw 15. Even though the areas 15*d* do not have the blade shape, the toner conveyed by the area 15*a* on the upstream side may be piled up, and the toner is dispersed outward in the direction of diameter of the screw 15 at a boundary portion between the area 15*a* and the area 15*d*, whereby the toner may be delivered to four corners of a cross section of the collected toner container 10B. Even though the areas 15*d* do not have the blade shape, the toner may be handed to the area 15*a* on the downstream side by growing the accumulation of the toner toward the upstream side and the downstream side with a boundary portion between the area 15*a* and the area 15*d* as a starting point. Even though the areas 15*d* do not have the blade shape, the toner may be filled into the collected toner container 10B via the process of (a) to (g) in FIG. 5 described above.

In this manner, even when the areas 15*d* having no blade are provided in the area 15*a* of the screw 15, the toner accumulates in the collected toner container 10 in a dispersed manner, and the built-up efficiency may be improved.

Third Embodiment

FIG. 10 is a cross-sectional view taken along a screw of a collected toner container of Third embodiment. The collected toner container 10C of Third embodiment has the same configuration as First embodiment other than that the screw blade pitch in areas 15*e* and 15*f* of the screw 15 are different and is controlled in the same manner. Therefore, members common to First embodiment in FIG. 10 are denoted by reference numerals common to those in FIG. 4, and overlapped description will be omitted. Although there are provided two areas 15*d* in First embodiment, only one of those may be described for the sake of convenience of description.

As illustrated in FIG. 10, the blade shape of the area 15*a* has an outer diameter of ϕ20 mm, an inner diameter of ϕ8 mm, and a pitch of 20 mm. A screw blade shape in the reverse feeding area 15*e* at the first position from the upstream side has the same outer diameter and shaft diameter as the screw blade shape in the area 15*a* on the upstream side, and increases in number of turns with a screw blade pitch of 10 mm, which is half that in the area 15*a*. A screw blade shape in the reverse feeding area 15*f* at the second position from the upstream side has the same screw blade shape, shaft diameter, and screw blade pitch as those of the area 15*a* on the upstream side thereof, and has an outer diameter of ϕ30 mm, which is 1.5 times that in the area 15*f*.

The areas 15*e* and 15*f* of the screw 15 have a direction of conveyance of the screw blade opposite to that in the area 15*a* on the upstream side, so that the accumulation of the toner is spread over the cross section of the collected toner container 10C, and the built-up efficiency may be improved.

Fourth Embodiment

Figure 11:
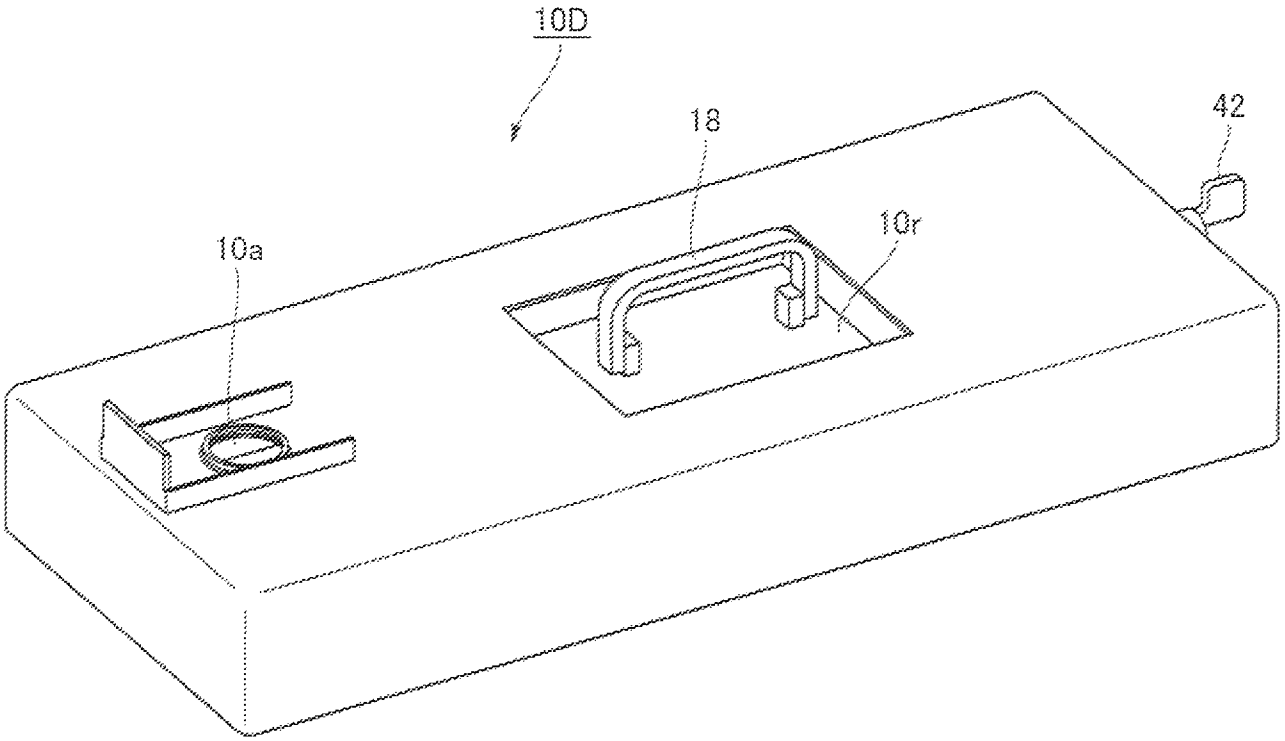
FIG. 11 is a perspective view of a collected toner container of Fourth embodiment.
Figure 12:
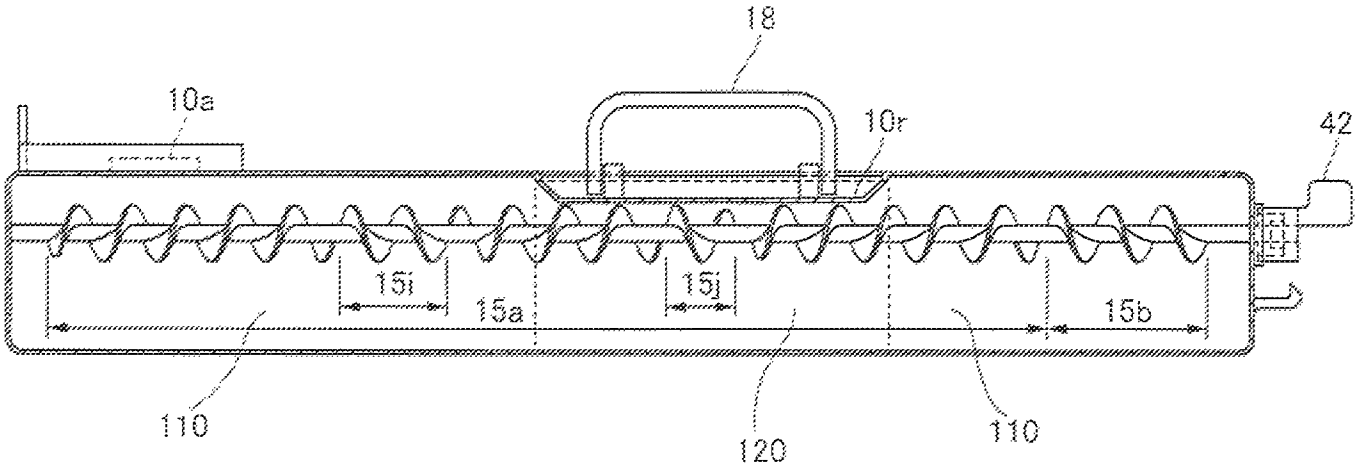
FIG. 12 is a cross-sectional view taken along a screw of the collected toner container according to Fourth embodiment.

FIG. 11 is a perspective view of a collected toner container of Fourth embodiment. FIG. 12 is a cross-sectional view taken along a screw of a collected toner container of Fourth Embodiment.

As illustrated in FIG. 11, an inside space of a collected toner container 10D of Fourth embodiment includes an area having a cross-sectional area taken along a plane perpendicular to the first direction smaller than other portions on one part thereof in the first direction. Corresponding to the area having a cross section smaller than other portions, a depressed portion 10*r* is formed on an upper surface of the collected toner container 10D. A handle 18 to be used when carrying the collected toner container 10D is stored in the depressed portion 10*r*. The handle 18 is stored in the depressed portion 10*r* provided on the upper surface of the collected toner container 10D, and is used by being rose when needed. The reverse feeding area 15*b* arranged in the area having the cross-sectional area smaller than other portions has a shorter length in the first direction than another reverse feeding area 15*b* arranged in another area.

As illustrated in FIG. 12, since the depressed portion 10*r* is provided, the height of a ceiling of the collected toner container 10D is partly low. If the height of the ceiling is low, a pressure of the developer in the periphery of the screw 15 can easily be increased. Therefore, the length of a reverse feeding area 15*j* is set to be shorter than the length of a reverse feeding area 15*i*. That is, the container portion of the collected toner container 10D includes a first area 110 and a second area 120 whose cross-sectional area orthogonal to the longitudinal direction being smaller than the first area 110 and length of the reverse conveyance section 15*i* in the axial direction in the second area 120 is shorter than that in the first area. In this example, the length of the reverse feeding areas (15*i*, 15*j*) arranged on the upstream side of the area 15*b* may be set to be the same. Accordingly, the filling efficiency may be further enhanced.

Other Examples

This disclosure may be implemented by other embodiments in which part or the entire part of the configuration of the embodiment is replaced by alternative configuration as long as the area where the conveyance is stopped is provided between the forward feeding areas of the screw arranged in the container and the developer is dispersed in the cross section of the container.

Therefore, the area where the conveyance is stopped includes a case where the conveyance performance in the direction opposite to the forward conveyance section located before or after is exhibited in association with the rotation, a case where the conveyance performance in the forward direction is smaller than that of the forward conveyance section, and a case where the conveyance performance in the forward direction is not exhibited in association with the rotation.

The appearance configuration of the collected toner container is not limited to a rectangular parallelepiped. The inlet port may be arranged at a center portion of the plane on an upper surface of the collected toner container, and the screw may be arranged so as to pass below the inlet port and traversing the collected toner container.

As long as the collected toner container configured to disperse the developer in the container by using the screw, any types of image forming apparatus may be implemented. The dimensions, mediums, shape, and relative arrangement of the components described in Examples 1 to 3 are not intended to limit the scope of this disclosure thereto, unless otherwise indicated.

In First embodiment, the collected toner container configured to accumulate the toner collected from the photoconductive drum and the intermediate transfer belt has been described. However, this disclosure may be implemented also by the collected toner container configured to collect and accumulate developer deteriorated in the developing unit. In First embodiment, the collected toner container configured to accumulate the toner collected by the blade cleaning unit has been described. However, this disclosure may be implemented also in a collected toner container configured to accumulate toner collected by a brush cleaning unit, or an electrostatic cleaning unit.

The collected toner container is not limited to a mode mounted on the image forming apparatus, but may be implemented as an independent processing unit, or a component to be coupled to other processing units. In this embodiment, only the main parts relating to formation and transfer of the toner image has been described. However, this disclosure may be implemented in various applications such as printers, various printing apparatus, copying machine, facsimile, and multifunction machine with required apparatus, equipment, and a housing structure added thereto.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-133291, filed on Jun. 26, 2013, and Japanese Patent Application No. 2014-118393, filed on Jun. 9, 2014 which are hereby incorporated by reference herein in their entirety.

What is claimed is:

1. A collected toner container comprising:

a container with a collecting port receiving a collected toner on one end in a longitudinal direction;

a conveying member arranged rotatably in the container to convey the toner collected from the collecting port from the one end toward the other end, the conveying member comprising:

a plurality of forward conveyance sections configured to convey the toner from the one end to the other end; and a plurality of reverse conveyance sections configured to convey the toner in a direction opposite to the forward conveyance sections and arranged alternately with the forward conveyance sections in an axial direction, wherein at least a downstream-most reverse conveyance section has a screw member, a toner feeding ability of the downstream-most reverse conveyance section in the direction of conveyance of the forward conveyance sections, to feed the toner in the direction opposite to conveyance of the forward conveyance sections, is formed to be largest among the plurality of reverse conveyance sections, and a number of screw blades of the downstream-most reverse conveyance section is greatest among the plurality of reverse conveyance sections.

2. The collected toner container according to claim 1, wherein an interior of the container is a substantially rectangular parallelepiped.

3. The collected toner container according to claim 1, wherein the container includes a first area, and a second area having cross-sectional area orthogonal to the longitudinal direction that is smaller than the cross-sectional area orthogonal to the longitudinal direction of the first area, and wherein a length of the reverse conveyance sections in the axial direction in the second area is shorter than that in the first area.

4. The collected toner container according to claim 3, wherein a depressed portion is formed on an upper surface of the container at a position corresponding to the second area, and a handle used for carrying the container is stored in the depressed portion.

5. The collected toner container according to claim 1, wherein each of the reverse conveyance sections is a screw member and a length of the screw member of the downstream-most reverse conveyance section is longest among the plurality of reverse conveyance sections.

6. The collected toner container according to claim 1, further comprising:

a storage portion configured to project from a side surface of the container in the other end and indicate a full condition of the container by storing the toner conveyed by the conveying member by a predetermined amount therein.

7. The collected toner container according to claim 1, wherein another of the plurality of reverse conveyance sections has no screw blade.

8. The collected toner container according to claim 1, wherein the downstream-most reverse conveyance section is disposed at a most end portion of the conveying member.

9. A collected toner container comprising:

an opening portion provided on one end in a longitudinal direction of the collected toner container, the opening portion being configured to receive a collected toner;

a containing portion configured to contain a collected toner collected from the opening portion; and a conveying member arranged rotatably in the container to convey the toner contained in the containing portion from the one end toward another end, the conveying member comprising:

first and second forward conveyance sections configured to convey the toner from the one end to the other end;

an interference section configured to interfere with conveyance of the toner in a direction of conveyance of the first and second forward conveyance sections and arranged between the first forward conveyance section and second forward conveyance section; and a reverse conveyance section arranged at a downstream side of the first and second forward conveyance sections in the direction of conveyance of the first and second conveyance sections and adjacent to the other end, the reverse conveyance section being configured to convey the toner in a direction opposite to conveyance of the first and second forward conveyance sections, wherein a toner feeding ability of the reverse conveyance section in the direction opposite to conveyance of the first and second forward conveyance sections is larger than a toner feeding ability of the interference section.

10. The collected toner container according to claim 9, wherein an interior of the container is a substantially rectangular parallelepiped.

11. The collected toner container according to claim 9, wherein the container includes a first area, and a second area having cross-sectional area orthogonal to the longitudinal direction that is smaller than a cross-sectional area orthogonal to the longitudinal direction of the first area, and wherein a length of the interference section in an axial direction in the second area is shorter than that in the first area.

12. The collected toner container according to claim 11, wherein a depressed portion is formed on an upper surface of the container at a position corresponding to the second area, and a handle used for carrying the container is stored in the depressed portion.

13. The collected toner container according to claim 9, wherein the reverse conveyance section has a screw member.

14. The collected toner container according to claim 13, wherein the interference section has a screw member and a length of the screw member of the reverse conveyance section is longer than a length of the screw member of the interference section.

15. The collected toner container according to claim 13, wherein the interference section has a screw member and a number of screw blades of the reverse conveyance section is greater than a number of screw blades of the interference section.

16. The collected toner container according to claim 9, wherein the interference section has no screw blade.

17. The collected toner container according to claim 9, further comprising:

a storage portion configured to project from a side surface of the container in the other end and indicate a full condition of the container by storing the toner conveyed by the conveying member by a predetermined amount therein.

18. The collected toner container according to claim 9, wherein the reverse conveyance section is disposed at a most end portion of the conveying member.

19. A collected toner container comprising:

a container with a collecting port receiving a collected toner on one end in a longitudinal direction;

a conveying member arranged rotatably in the container to convey the toner collected from the collecting port from the one end toward the other end, the conveying member comprising:

a plurality of forward conveyance sections each of which comprises a forward screw portion to convey the toner from the one end to the other end; and a plurality of reverse conveyance sections arranged alternately with the forward conveyance sections in an axial direction of the conveying member, each of the reverse conveyance sections comprising a reverse screw portion to convey the toner in a direction opposite to the direction the forward conveyance sections convey the toner, wherein the forward conveyance sections of the plurality of forward conveyance sections are separated from each other by a reverse conveyance section of the plurality of reverse conveyance sections, and wherein a downstream-most reverse conveyance section that is arranged at a most downstream side among the plurality of reverse conveyance sections in the direction of conveyance of the forward conveyance sections is formed such that a length, in the axial direction of the conveying member, of the downstream-most reverse conveyance section is longest among the plurality of reverse conveyance sections.

20. The collected toner container according to claim 19, wherein an interior of the container is a substantially rectangular parallelepiped.

21. The collected toner container according to claim 19, wherein the container includes a first area, and a second area having cross-sectional area orthogonal to the longitudinal direction that is smaller than the cross-sectional area orthogonal to the longitudinal direction of the first area, and wherein a length of the reverse conveyance sections in the axial direction in the second area is shorter than that in the first area.

22. The collected toner container according to claim 21, wherein a depressed portion is formed on an upper surface of the container at a position corresponding to the second area, and a handle used for carrying the container is stored in the depressed portion.

23. The collected toner container according to claim 19, wherein a number of screw blades of the downstream-most reverse conveyance section is greatest among the plurality of reverse conveyance sections.

24. The collected toner container according to claim 19, wherein a pitch of the screw blades of the downstream-most reverse conveyance section is largest among the plurality of reverse conveyance sections.

25. The collected toner container according to claim 19, further comprising:

a storage portion configured to project from a side surface of the container in the other end and indicate a full condition of the container by storing the toner conveyed by the conveying member by a predetermined amount therein.

26. The collected toner container according to claim 19, wherein the downstream-most reverse conveyance section is disposed at a most end portion of the conveying member.

27. A collected toner container comprising:

a container with a collecting port receiving a collected toner on one end in a longitudinal direction;

a conveying member arranged rotatably in the container to convey the toner collected from the collecting port from the one end toward the other end, the conveying member comprising:

first and second forward conveyance sections each of which has a screw member to convey the toner from the one end to the other end;

a screw-less section configured to be formed with no screw blade and arranged between the first forward conveyance section and the second forward conveyance section, a length of the screw-less section being longer than a pitch of screw blades of the first forward conveyance section and a pitch of screw blades of the second forward conveyance section, respectively; and a reverse conveyance section arranged at a downstream side of the first and second forward conveyance sections in the direction of conveyance of the first and second conveyance sections and adjacent to the other end, the reverse conveyance section being configured to have a screw to convey the toner in a direction opposite to conveyance of the first and second forward conveyance sections.

28. The collected toner container according to claim 27, wherein an interior of the container is a substantially rectangular parallelepiped.

29. The collected toner container according to claim 27, further comprising:

a storage portion configured to project from a side surface of the container in the other end and indicate a full condition of the container by storing the toner conveyed by the conveying member by a predetermined amount therein.

30. The collected toner container according to claim 27, wherein the reverse conveyance section is disposed at a most end portion of the conveying member.

31. A collected toner container comprising:

a container with a collecting port receiving a collected toner on one end in a longitudinal direction;

a conveying member arranged rotatably in the container to convey the toner collected from the collecting port from the one end toward the other end, the conveying member comprising:

a plurality of forward conveyance sections each of which comprises a forward screw portion to convey the toner from the one end to the other end; and a plurality of reverse conveyance sections arranged alternately with the forward conveyance sections in an axial direction of the conveying member, each of the reverse conveyance sections comprising a reverse screw portion to convey the toner in a direction opposite to the direction the forward conveyance sections convey the toner, wherein the forward conveyance sections of the plurality of forward conveyance sections are separated from each other by a reverse conveyance section of the plurality of reverse conveyance sections, and wherein a downstream-most reverse conveyance section that is arranged at a most downstream side among the plurality of reverse conveyance sections in the direction of conveyance of the forward conveyance sections is formed such that a toner conveyance amount, per one rotation of the conveying member, of the downstream-most reverse conveyance section is largest among the plurality of reverse conveyance sections.

32. The collected toner container according to claim 31, wherein an interior of the container is a substantially rectangular parallelepiped.

33. The collected toner container according to claim 31, wherein the container includes a first area, and a second area having cross-sectional area orthogonal to the longitudinal direction that is smaller than the cross-sectional area orthogonal to the longitudinal direction of the first area, and wherein a length of the reverse conveyance sections in the axial direction in the second area is shorter than that in the first area.

34. The collected toner container according to claim 32, wherein a depressed portion is formed on an upper surface of the container at a position corresponding to the second area, and a handle used for carrying the container is stored in the depressed portion.

35. The collected toner container according to claim 31, wherein a number of screw blades of the downstream-most reverse conveyance section is greatest among the plurality of reverse conveyance sections.

36. The collected toner container according to claim 31, wherein a pitch of the screw blades of the downstream-most reverse conveyance section is largest among the plurality of reverse conveyance sections.

37. The collected toner container according to claim 31, further comprising:

a storage portion configured to project from a side surface of the container in the other end and indicate a full condition of the container by storing the toner conveyed by the conveying member by a predetermined amount therein.

38. The collected toner container according to claim 31, wherein the downstream-most reverse conveyance section is disposed at a most end portion of the conveying member.

* * * * *